United States Patent [19]

Molzan et al.

[11] 4,274,404

[45] Jun. 23, 1981

[54] OXYGEN SUPPLY SYSTEM CONTROLLED BY USER EXHALATION

[75] Inventors: Albert R. Molzan, Alhambra; James D. Cleary, Monrovia, both of Calif.

[73] Assignee: American Safety Flight Systems, Inc., Glendale, Calif.

[21] Appl. No.: 29,824

[22] Filed: Apr. 13, 1979

[51] Int. Cl.[3] ..... A62B 7/00

[52] U.S. Cl. ..... 128/204.25; 128/204.26; 128/205.24; 137/505.25

[58] Field of Search ..... 128/204.25, 204.26, 128/204.27, 205.11, 205.24, 205.25; 137/505.25

[56] References Cited

U.S. PATENT DOCUMENTS

| | | | |
|---|---|---|---|
| Re. 23,845 | 6/1954 | Seeler | 128/204.25 |
| 2,615,463 | 10/1952 | Burns | 128/205.24 X |
| 2,897,883 | 8/1959 | Seeler | 128/205.11 X |
| 3,075,546 | 1/1963 | Roberts et al. | 137/505.25 |
| 3,276,462 | 10/1966 | Matchett | 137/505.25 X |
| 3,285,261 | 11/1966 | Chaney | 128/204.26 X |
| 3,456,642 | 7/1969 | Cupp | 128/204.26 |
| 3,768,466 | 10/1973 | Johnson | 128/204.26 |
| 3,875,957 | 4/1975 | Veit et al. | 128/205.11 X |

FOREIGN PATENT DOCUMENTS

| | | | |
|---|---|---|---|
| 1104829 | 4/1961 | Fed. Rep. of Germany | 128/204.26 |
| 1228481 | 4/1971 | United Kingdom | 128/204.26 |
| 537682 | 1/1977 | U.S.S.R. | 128/204.24 |

*Primary Examiner*—Henry J. Recla

*Attorney, Agent, or Firm*—Poms, Smith, Lande & Rose

[57] ABSTRACT

An oxygen supply system for human inhalation of oxygen at a constant oxygen flow rate is provided including an oxygen cylinder having a pressure regulator to provide a source of pressure regulated oxygen which is passed through a fluid restrictor nozzle having a metering orifice to provide a constant volume oxygen flow to an oxygen inhalation mask through a first oxygen hose connected to the cylinder and a second mask hose connected to the inhalation mask. An oxygen flow shut-off valve is provided in a normally open position to allow oxygen flow normally from the cylinder through the hoses and through an inhalation valve in the mask to the user. A fluid pressure responsive diaphragm is provided in association with the oxygen flow shut-off valve to shut-off oxygen flow to the mask when oxygen pressure buildup in the mask hose exceeds a predetermined amount, such buildup occurring when user exhalation closes the mask inhalation valve.

2 Claims, 3 Drawing Figures

10
11
11a
12
13
14
17
20
21
21a
22
23
24
25
26
27
28
29
30
31
32

OXYGEN SUPPLY SYSTEM CONTROLLED BY USER EXHALATION

BACKGROUND OF THE INVENTION

This invention relates in general to oxygen supply systems for providing oxygen for human inhalation, and more particularly, to such systems suited for use by aviators or parachutists who require a life support oxygen supply system while in oxygen short environments.

Various types of life supporting oxygen supply systems have been employed heretofore, particularly in association with military aviator and parachutist use. It has come to our attention that the prior systems have not been entirely satisfactory in assuring both the oxygen supply to the user and being compatible to the user's comfort at normal breathing pressures.

Constant volume oxygen flow systems have been provided heretofore which provide for a normal flow of oxygen to the inhalation mask, but without a suitable way to shut-off the oxygen flow, causing some oxygen to blow by the user escaping from the mask and frequently causing difficulty in exhalation by the user such that the user might have to separate the mask somewhat from his face in order to exhale. Where oxygen flow continues while the user attempts to exhale, the constant flow of the system buildsup excessive back pressure preventing the mask exhalation valve from opening properly and can result in improper mask operation, oxygen waste, user discomfort and respiratory fatigue.

SUMMARY OF THE INVENTION

It is therefore the primary object of the present invention to provide an oxygen supply system having a constant volume flow rate of oxygen to a user inhalation means, such as a military oxygen mask, which will avoid exerting excessive oxygen supply pressures on the mask inhalation-exhalation valve so that the user will be able to breathe relatively normally, be able to exhale without having to overcome the full pressure of the oxygen supply and that proper mask operation will be promoted, oxygen waste eliminated, user discomfort and respiratory fatigue be avoided.

It is also an object of the present invention to provide an oxygen supply system of the constant volume type as aforestated which will be relatively of small size and weight, relatively simple in operation and of low cost in construction and operation in association with a pressure breathing mask in a compatible manner and with a maximum of oxygen economy.

It is a still further object of the present invention to provide an oxygen supply system as in the foregoing objects wherein air may be introduced in response to inspirational effort of the user of an amount which would exceed the constant volume oxygen flow and in a manner which is compatible with a constant flow volume pressure breathing mask system without requiring user inhalation as a requirement for oxygen supply in the system.

It is a still further object of the present invention to disclose and provide an oxygen supply system wherein a predetermined volume flow rate of oxygen is normally supplied to the inhalation means without additional user effort, beyond initial turning on of the system, wherein oxygen flow normally occurs to the inhalation means and such oxygen flow is shut-off in response to user exhalation pressures normally developed during a normal breathing exhalation by the user.

Generally stated, the present invention in oxygen supply system includes the provision of a source of pressure regulated oxygen, and oxygen inhalation means for human use for inhalation of oxygen, fluid conduit means for connecting the oxygen source with the inhalation means, and inhalation valve means fluidly connected to the conduit means and inhalation means for normally opening to allow oxygen flow to the inhalation means under the fluid pressure of oxygen normally in said conduit means and for closing on exhalation of the human user into the inhalation means, oxygen flow shut-off means fluidly connected into the conduit means for shutting off oxygen flow from said source to said inhalation means when in an oxygen flow shut-off position and pressure responsive actuator means for actuating said shut-off means to said oxygen flow shut-off position in response to oxygen pressure buildup in said conduit means between said shut-off means and said inhalation valve means when said inhalation valve means is closed by user exhalation.

More particularly stated, the oxygen supply system of the present invention further comprises oxygen flow restrictor means for restricting the volume rate of fluid flow of oxygen through the conduit means whereby oxygen is supplied at a constant volume rate of fluid flow to the inhalation means and air inlet means are connected into the conduit means for introducing ambient air into the inhalation means in response to user inhalation at a fluid volume flow rate in excess of the constant volume flow rate of oxygen being supplied to said inhalation means. More particularly, the oxygen flow shut-off means includes an oxygen supply orifice and an orifice closing valve member and the actuator means includes a pressure responsive diaphragm means for mounting the valve member to engage and close the orifice in response to the aforestated oxygen pressure buildup. In a preferred embodiment of the invention, the oxygen flow restrictor means includes a flow restricting nozzle having an end opening providing the aforementioned orifice and the diaphragm means aforetostated includes an annular diaphragm mounted about the nozzle and in turn mounting the valve member to close the orifice on pressure buildup in the system as previously stated.

As is further generally contemplated within the present invention, a method of supplying oxygen to a user thereof is provided by the present invention including the steps of establishing a constant volume flow rate of oxygen at a regulated pressure from a source thereof in a supply conduit to user inhalation means, opening a conduit shut-off valve and an inhalation valve in the inhalation means by the regulatored pressure in the supply conduit, closing the inhalation valve by exhalation of the user and closing the shut-off valve by oxygen pressure buildup between the shut-off valve and the inhalation valve when the inhalation valve is closed, such that a constant volume of oxygen fluid flow is provided normally to the user, subject to interruption only on user exhalation which causes closing of the inhalation valve and consequently a pressure buildup in the conduit between the valves which causes the shut-off valve and relieves the inhalation valve of the full pressure of the source. More particularly, the method of the present invention includes the further step of operating an air inlet to the conduit by user inhalation when the fluid volume rate of inhalation of the user exceeds the established constant volume flow rate of oxygen normally flowing without the presence of user inhalation.

A preferred exemplary embodiment of apparatus of the oxygen supply system and the method of supplying oxygen to a user thereof, in accordance with the present invention, will now be described in detail. Reference will be made to the appended sheets of drawings which will be described briefly prior to the detailed description which follows.

DETAILED DESCRIPTION

Figure 1:
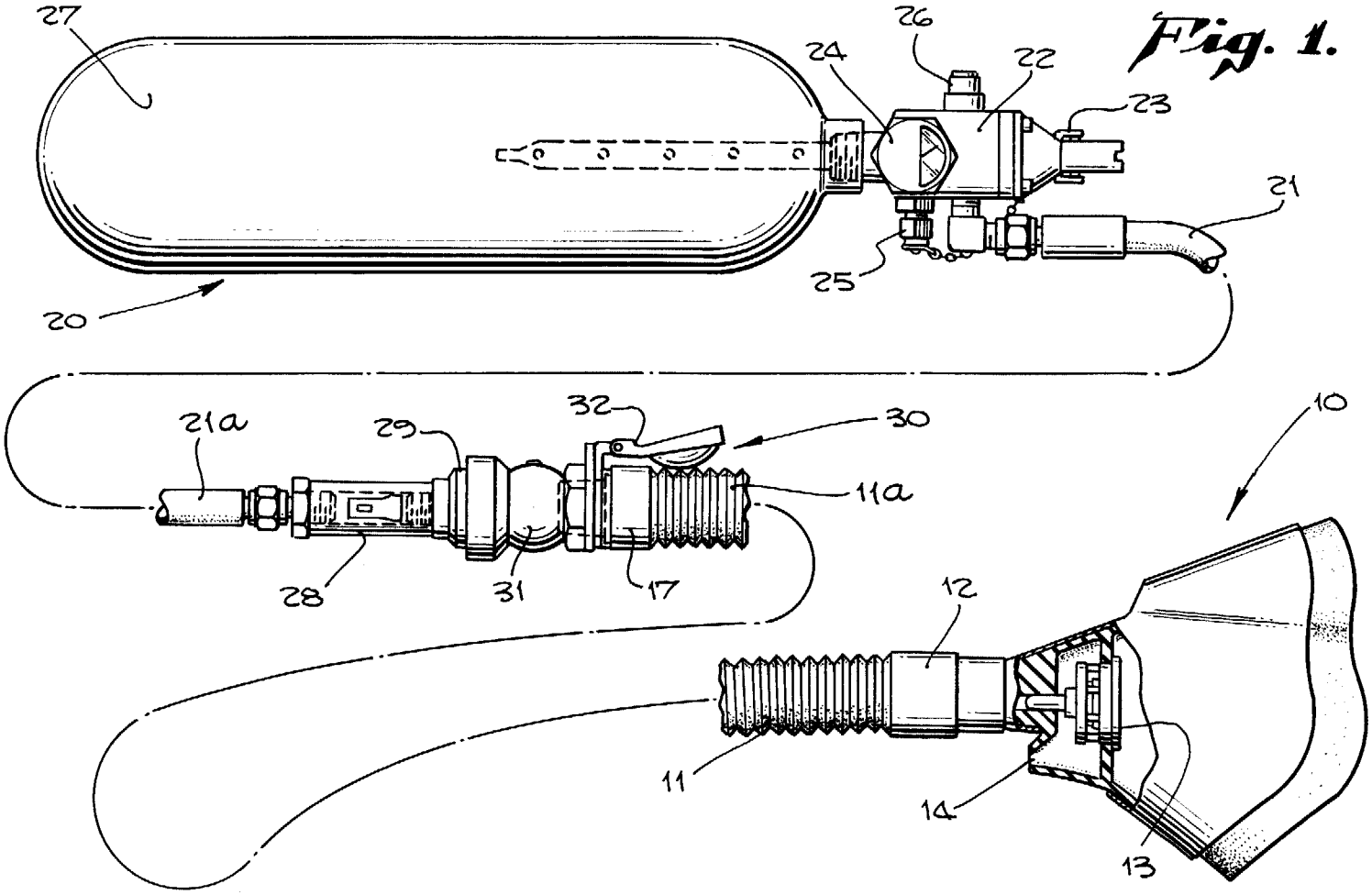
FIG. 1 is an assembly view of an exemplary embodiment of oxygen supply system in accordance with the present invention and illustrating, in general, a source of pressure regulated oxygen, and oxygen inhalation means for human use and oxygen metering and air inlet valve means connected into fluid conduit means join the oxygen source to the inhalation means.

Referring initially to FIG. 1, an exemplary embodiment of oxygen supply system, according to the present invention, is illustrated including an exemplary oxygen inhalation means indicated generally at 10, and exemplary source of pressure regulated oxygen, indicated generally at 20 and an exemplary oxygen metering and air inlet valve means indicated generally at 30.

The inhalation means indicated generally at 10, in the exemplary embodiment, comprises a military type oxygen mask, known per se, and may be made in accordance with military specification Mil-M-27274. As is known in the construction of such oxygen mask, a mask hose 11 is connected by an end fitting 12 to the mask in fluid communication with a double diaphragm, spring biased inhalation valve 13. The inhalation valve means 13, being of the double diaphragm type, opens under the force of oxygen pressure in hose 11 to allow oxygen low into the mask and, on exhalation by the user of a sufficient amount to overcome the fluid pressure within conduit 11, closes the mask to oxygen flow from hose 11 and opens the mask to exhalation through exhalation port 14. In prior use of oxygen masks of this type, it has been found to be difficult at times to close the inhalation valve 13 by user exhalation of normal amounts due to the high pressures heretofore experienced in prior constant volume systems. Inhalation valve 13, for purposes of the present application, assumes a normally open position allowing oxygen flow into the mask at less than 1 inch of water pressure. As will be discussed hereinafter, pressure buildup in hose 11 which might make user exhalation uncomfortable or overly difficult is avoided in accordance with the present invention.

The source of pressure regulated oxygen indicated generally at 20 in the exemplary embodiment is connected into an oxygen conduit 21 via a pressure reducing, or regulating assembly in known manner including an on-off lever 23 (shown in off position), reservoir pressure gauge 24, filler valve 25, pressure relief valve 26 and oxygen cylinder 27. Cylinder 27 is preferably of approximately 96 cubic inches in volume and typically is provided with 1800 psi oxygen pressure. The pressure regulator assembly 22 is preferably set to provide a 50 psi, ±10 psi oxygen pressure to conduit 21.

Figure 2:
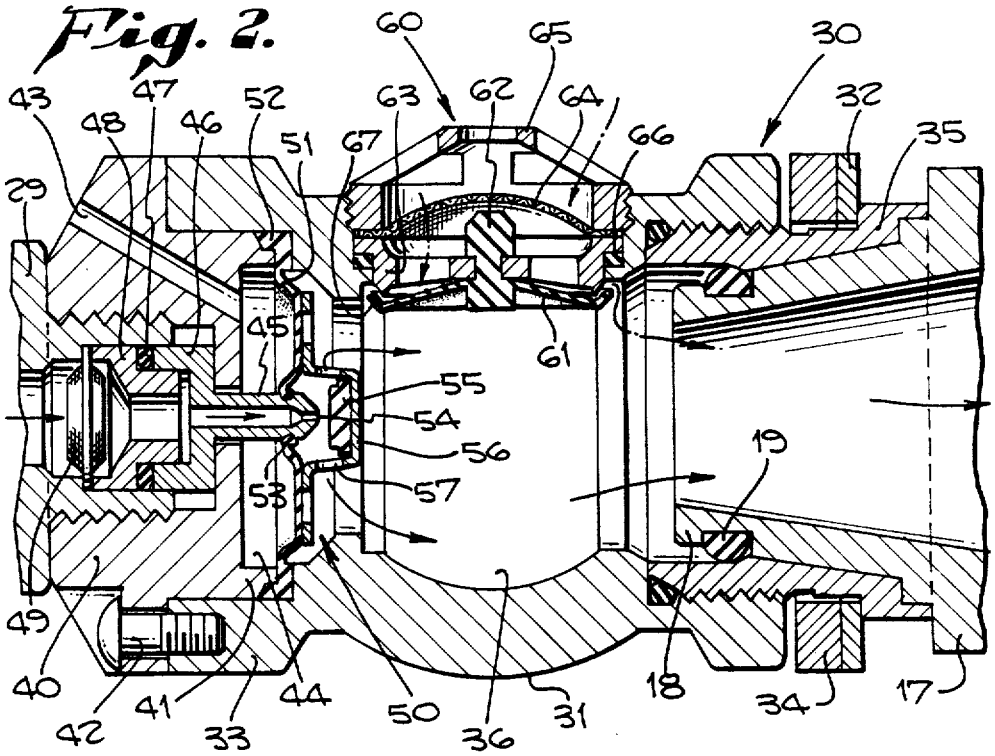
FIG. 2 is a section view of the oxygen metering and air inlet valve means of the system of FIG. 1 illustrated in an oxygen and air supplying mode.

As can be seen from the foregoing, and reference to FIG. 1, the inhalation means indicated generally at 10 and pressure regulated oxygen source indicated generally at 20 are connected by fluid conduit means inclusive of a first conduit, mask hose 11 and a second conduit, oxygen hose 21, in the exemplary embodiment. As will be discussed hereinafter, the oxygen metering and air inlet means indicated generally at 30 is connected into conduits 11 and 21 with the opposite end **11*a* of mask hose 11 being shown connected by its hose end fitting 17 and the second conduit, oxygen hose 21, being shown connected by its hose end 21*a* to an optionally provided flow indicator 28 (of known construction) via connecting fitting 29. The metering and inlet valve means includes a valve body 31 to which the connectors 17 and 29 are fitted, there being a conventional hose clamp assembly 32 for releasably engaging end fitting 17 to body 31. As seen in FIG. 2, end fitting 17 is provided with a nose end 18 mounting seal ring 19** to fluidly connect into the valve body.

Referring now to FIG. 2, the exemplary embodiment of oxygen metering and air inlet valve means, indicated generally at 30, will be described in detail. As noted above, the valve body 31 is connected into the first and second conduits 11 (to the inhalation means) and 21 (from the regulated pressure oxygen source) by the end fittings 17 and 29, respectively, as seen in FIG. 2. Nose end 18 at fitting 17, mounting the seal ring 19, is held by hose clamp assembly 32 to body flange 34 via the interaction between clamp assembly 32 and connector 35, the latter being threaded into flange 34 as seen in FIG. 2. This quick connect-disconnect assembly is known per se and does not form a part of the present invention.

Oxygen flow restrictor means for restricting the volume rate of fluid flow of oxygen through the system of the present invention are provided whereby oxygen is supplied at a constant volume rate of fluid flow through the inhalation means. In the exemplary embodiment, such restrictor means includes a metering nozzle 45 formed integrally of a restrictor means 46 seen at the lefthand side of FIG. 2. A housing end cap 40 having boss portion 41, and containing an air passage 43 to ambient, is mounted by fasteners, as bolt 42, conventionally a button head screw, to valve body lefthand annular flange 33 providing an ambient chamber 44 with diaphragm means described hereinafter. The restrictor means 46 is mounted within housing cover 40 as illustrated with a fluid sealing O-ring 47 disposed between it and keeper 48 held in place by end fitting 29, threaded within housing cover 40, with filter 49 disposed between keeper 48 and end fitting 29. Filter 49 may be of the known type and of approximately 20 micron size. Importantly, for purposes of the present invention, the restrictor means 46 and nozzle 45, are provided with a metering orifice 54 which restricts oxygen flow to a constant volume flow rate when the oxygen inlet valve assembly, described hereinafter, is in an open position. Preferably, metering orifice 54 has a size on the order of 0.014 inches diameter to provide a flow rate of 5.2 liters under the regulated pressure discussed hereinbefore for a 30,000 foot use rating and on the order of approximately 0.020 inches diameter to provide approximately 8.2 liters per minute flow for a 35,000 foot rating. These ratings are of importance when the system of the present invention is used as an emergency oxygen system for parachute descent or a "walk around" emergency system for use in aircraft.

As is particularly contemplated within the present invention, oxygen flow shut-off means are provided for shutting off oxygen flow from the source, and from the restrictor nozzle 45 in the exemplary embodiment, to the inhalation means in response to pressure buildup in the system between the shut-off means and the inhalation means as will now be described in detail. The exemplary oxygen inlet valve assembly, indicated generally at 50, includes annular diaphragm 51 mounted by its outer peripheral bead 52 to valve body 31, bead 52 being clamped between boss portion 41 of housing cover 40, flange 33 of the valve body and the body portions adjacent flange 33 as seen in FIG. 2. An inner annual bead 53 of diaphragm 51 is fitted to and sealingly engages about nozzle 45, isolating ambient pressure chamber 44 on one side of diaphragm 51 with the valve body chamber 36 on the other side.

Figure 3:
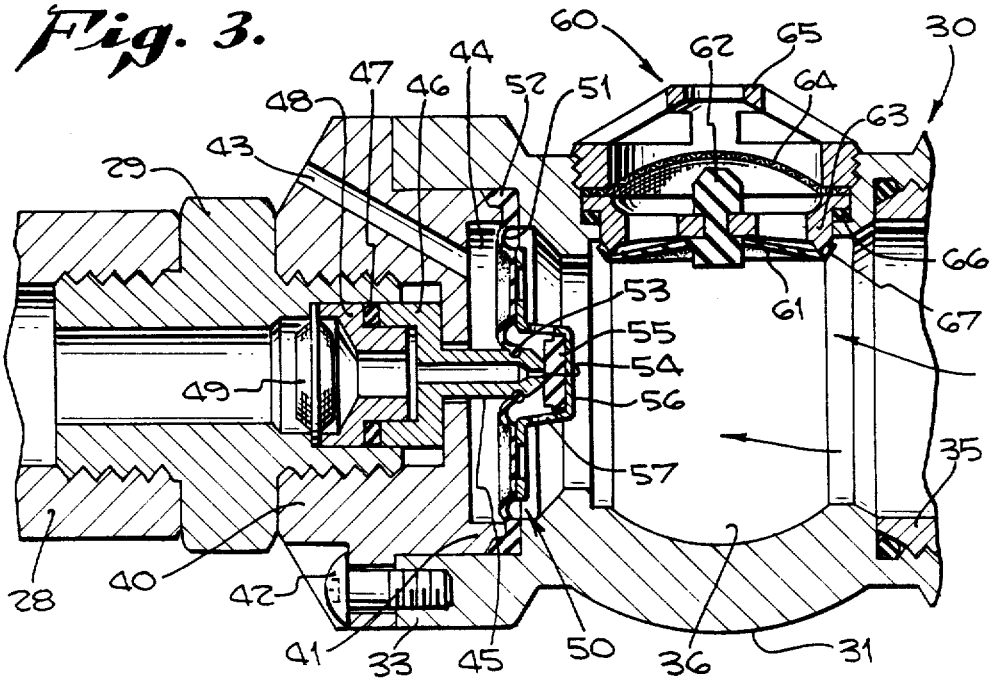
FIG. 3 is a section view as in FIG. 2 showing the valve means in an oxygen shut-off and ambient air shut-off mode.

Oxygen shut-off seat or valve member 55 is mounted by diaphragm disk 56, having ports 57, directly to the diaphragm 51. Disk 56 may be adhesively or mechanically secured to the diaphragm to mount valve member 55 with its flat seat facing the truncated cone configured end of nozzle 45 to seal orifice 54 when moved to the oxygen shut-off position illustrated in FIG. 3. Diaphragm 51 functions as a pressure responsive actuator for actuating the shut-off means to the oxygen flow shut-off position of FIG. 3 in response to oxygen pressure builup within chamber 36, and portions of the conduit means downstream (toward mask 10) as discussed further hereinafter.

Air inlet means are connected into the conduit means of the exemplary oxygen supply system of the present invention for introducing ambient air into the inhalation means in response to user inhalation at a fluid volume flow rate in excess of the constant volume flow rate of oxygen being supplied. In the exemplary embodiment, such air inlet means is indicated generally at 60 and includes a check leaf-valve member 61 mounted by support 62 to valve seat 63. An air screen 64, preferably a 60 mesh inlet screen, is positioned over seat 63 with cap 65 being threaded to body 31 to hold screen 64 and seat 63 down against seal 66 on valve body 31. The exemplary check leaf-valve member 61 is mounted by its stationary center support 62 and has an annular diaphragm configuration with free peripheral edge 67 adapted to seal against the downwardly facing circular edge of seat 63 when in the air shut-off position of FIG. 3. Air check valve 61 of the present exemplary embodiment is provided in such a manner as to open to allow the inflow of ambient air when a negative pressure occurs in chamber 36 within body 31. Preferably, valve member 61 will open when a negative pressure exists which is of smaller magnitude than a negative 2 inches of water pressure in chamber 36. Importantly, the oxygen inlet valve assembly, indicated generally at 50, is provided so that valve member 55 closes on orifice 54 of nozzle 45 under the action of diaphragm 51 when a maximum of 2 inches of water pressure is experienced within the body chamber 36, in accordance with the present invention, so that user exhalation of normal comfortable amounts of pressure will turn off the oxygen supply, the length of duration of the oxygen supply will be extended and the overall user comfort experienced with using the system will be improved as contemplated within the present invention.

Mode of Operation

As can be seen from the foregoing detailed description of an exemplary apparatus for the oxygen supply system of the present invention, a new and improved method of supplying oxygen to a user thereof has been provided by the present invention in a better and more facile manner. Assuming the provision of the source of oxygen in cylinder 27 providing a regulated air pressure on the order of 50 pounds per square inch available in oxygen conduit 21 of the exemplary embodiment, a constant volume flow rate thereof is provided by the oxygen flow restrictor means including nozzle 45 and orifice 54 on the order of 5.2 liters per minute to 8.2 liters per minute depending upon the altitude rating desired for the system. The oxygen pressure and constant volume flow rate is employed, according to the present invention, to open the oxygen inlet valve assembly indicated generally at 50 so that oxygen is constantly flowing without any additional effort by the user beyond turning on the on-off lever 23 at the initiation of use of the system. Such oxygen flow can be assumed to close the air inlet valve indicated generally at 60 and, open the inhalation valve 13 of the inhalation means indicated generally at 10. Therefore, according to the present method, a constant volume flow rate of oxygen is normally supplied from the cylinder 27 through conduit 21, through the oxygen metering and air inlet valve indicated generally at 30 and conduit 11 to the inhalation means indicated generally at 10 without any additional effort by the user. In the event that the user is a parachutist who is evacuated from an aircraft in an emergency or other situation, and assuming he has turned the system on, the supply of oxygen to his inhalation means is assured by the present system's normal operating condition without the need for his opening the inhalation valve or other oxygen supply valve by an inhalation effort. However, on exhalation by the user, and as particularly contemplated within the present invention, the user's exhalation effort will initially close inhalation valve 13 and oxygen pressure buildup will occur within the conduit means upstream (toward the pressure source) of valve 13. Wherein prior constant volume flow situations such pressure buildup has prevented closing of the inhalation valve 13, or required extreme user exhalation pressure to close the valve and allow exhalation, as is particularly contemplated within the present invention, the pressure buildup of oxygen within conduit 11 and valve body chamber 36 to a maximum of 2 inches of water pressure acting upon diaphragm 51 will cause the diaphragm to actuate valve member 54 to its closed position of FIG. 3 turning off the oxygen supply and preventing further pressure buildup within conduit 11 upstream of inhalation valve 13. The inhalation valve, and thus the user, are relieved of the pressure buildup which might otherwise occur within conduit 11 leading to the inhalation means if the pressure responsive means including diaphragm 51 were not provided in the manner of the present invention.

Having thus described an exemplary embodiment of an oxygen supply system in accordance with the present invention, and having described the method and mode of operation thereof, it is believed that the foregoing objects stated herein are attained by the system of the present invention and that it should be apparent to those skilled in the art that various modifications, adaptions and alterations can be made to the system of the exem-plary embodiment described in detail herein without departing from the scope of the invention which is defined by the following claims.

We claim:

1. In a constant-volume oxygen supply system including a source of pressure regulated oxygen, an oxygen inhalation means for human use for inhalation of oxygen and exhalation to atmosphere, and fluid conduit means for connecting said source with said inhalation means, the improvement comprising the provision of:

an inhalation valve means, disposed in said inhalation means, and fluidly connected to said conduit means, for normally opening to allow oxygen to flow to said inhalation means from said oxygen source at a relatively constant volume flow rate under the fluid pressure of oxygen normally in said conduit means, and for closing on exhalation of the human user into the inhalation means, said closing of said inhalation valve means by exhalation resulting in a buildup of oxygen pressure in said conduit means, whereby oxygen from said source is supplied to the human user at a predetermined volumetric flow rate, without requiring any effort by the human user, until the user exhales;

oxygen flow control means fluidly connected into said conduit means for supplying oxygen and for shutting off oxygen flow from said source to said inhalation means when in respective oxygen flow supplying and shut-off positions; and pressure responsive actuator means, for actuating said control means to said oxygen supplying position solely in response to said source pressure and to said oxygen flow shut-off position when said pressure buildup reaches a predetermined level, thereby preventing further pressure buildup in said conduit means, whereby the human user is able to exhale without having to overcome the pressure level of said oxygen source, and for providing an oxygen flow path between said oxygen supply and said inhalation means when said inhalation means is open;

said oxygen flow control means including an oxygen flow restrictor nozzle means having an outlet orifice disposed in said conduit means and fluidly connected to said oxygen source for restricting the volume rate of fluid flow of oxygen through said conduit means to supply oxygen at a constant volume rate of fluid flow to said inhalation means;

said pressure responsive actuator means including a pressure responsive diaphragm means concentrically disposed in said conduit means about said nozzle means and secured to said nozzle means and said conduit means, said diaphragm means communicating with atmosphere at the upstream side thereof and communicating with pressure in said conduit means at the downstream side thereof, said actuator means further including valve seat means extending from said diaphragm means and disposed adjacent said outlet orifice to abuttingly engage and close said nozzle means in response to said oxygen pressure buildup; and air inlet means connected into said conduit means for introducing ambient air into said inhalation means in response to user inhalation at a fluid volume flow rate in excess of said constant volume flow rate of oxygen being supplied to said user through said nozzle means whereby (i) the user receives oxygen at said constant volume flow rate through said normally-open inhalation means without any inhalation effort, and (ii) the user receives a mixture of air and oxygen at a greater volume than said constant volume by inhaling a volume of fluid greater than said constant volume of oxygen supplied to the user.

2. The improvement in oxygen supply system of claim 1 wherein:

said valve seat means comprises a cup-shaped member disposed about said nozzle means and mounted to said diaphragm means, said valve seat being mounted within said cup-shaped member, and said cup-shaped member having side ports whereby oxygen is supplied from said source to said conduit means through said ports prior to said pressure buildup.

* * * * *